US006835703B1

(12) United States Patent
Cho et al.

(10) Patent No.: US 6,835,703 B1
(45) Date of Patent: Dec. 28, 2004

(54) LIQUID AUTOMATIC DISHWASHING DETERGENT

(75) Inventors: Suk H. Cho, Idaho Falls, ID (US); Kathy Dillon, Idaho Falls, ID (US); James L. Kurtz, Idaho Falls, ID (US)

(73) Assignee: Melaleuca, Inc., Idaho Falls, ID (US)

( * ) Notice: Subject to any disclaimer, the term of this patent is extended or adjusted under 35 U.S.C. 154(b) by 0 days.

(21) Appl. No.: 09/751,047

(22) Filed: Dec. 29, 2000

Related U.S. Application Data

(60) Provisional application No. 60/173,852, filed on Dec. 30, 1999.

(51) Int. Cl.[7] ..... C11D 17/00

(52) U.S. Cl. ..... 510/221; 510/223; 510/226; 510/229; 510/230; 510/231; 510/421; 510/422; 510/439; 510/476; 510/506; 510/508

(58) Field of Search ..... 510/221, 223, 510/226, 229, 230, 231, 421, 422, 439, 476, 477, 508, 506, 343

(56) References Cited

U.S. PATENT DOCUMENTS

| | | | | | |
|---|---|---|---|---|---|
| 2,798,053 | A | | 7/1957 | Brown | 260/2.2 |
| 4,404,115 | A | * | 9/1983 | Tai | 252/135 |
| 4,431,559 | A | * | 2/1984 | Ulrich | 252/99 |
| 4,462,922 | A | | 7/1984 | Boskamp | 252/174.12 |
| 4,537,707 | A | * | 8/1985 | Severson, Jr. | 252/545 |
| 4,752,409 | A | | 6/1988 | Drapier et al. | 252/94 |
| 4,933,101 | A | | 6/1990 | Cilley et al. | 252/99 |
| 4,941,988 | A | | 7/1990 | Wise | 252/99 |
| 5,057,237 | A | | 10/1991 | Drapier et al. | 252/97 |
| 5,130,043 | A | | 7/1992 | Prince et al. | 252/95 |
| 5,169,552 | A | | 12/1992 | Wise | 252/95 |
| 5,269,960 | A | * | 12/1993 | Gray et al. | 252/174.12 |
| 5,399,284 | A | * | 3/1995 | Schreiber | 252/174.12 |
| 5,691,292 | A | * | 11/1997 | Marshall et al. | 510/221 |
| 5,962,388 | A | * | 10/1999 | Sherry et al. | 510/238 |
| 5,965,508 | A | * | 10/1999 | Ospinal et al. | 510/355 |
| 6,191,092 | B1 | * | 2/2001 | Bragulla et al. | 510/392 |

OTHER PUBLICATIONS

Flick, Ernest W., Household/Industrial Cleaners, in *Advanced Cleaning Product Formulations, Household, Industrial, Automotive*, Noyes Publications, Chapter 2, pp. 11–39.

* cited by examiner

*Primary Examiner*—Yogendra Gupta
*Assistant Examiner*—Preeti Kumar
(74) *Attorney, Agent, or Firm*—Fish & Richardson P.C., P.A.

(57) ABSTRACT

The invention provides liquid automatic dishwashing detergents (LADDs) that contain a detergent enzyme and have a pH value less than 7.0. Such LADDs can lack phosphate builders, chlorine bleaches, and alkali, each of which is undesirable from the perspective of human and environmental safety. In addition, the invention provides methods for cleaning tableware.

23 Claims, No Drawings

LIQUID AUTOMATIC DISHWASHING DETERGENT

This application claims priority from U.S. Provisional Application Ser. No. 60/173,852, filed Dec. 30, 1999.

BACKGROUND

1. Technical Field

The invention relates to liquid automatic dishwashing detergents. More particularly, this invention relates to liquid automatic dishwashing detergents with superior environmental and human safety as well as superior cleaning efficacy and stability.

2. Background Information

Powdered automatic dishwashing detergents are well suited to the task of effectively cleaning dishes in a home dishwashing machine. Such products typically contain relatively large amounts of phosphate builders, chlorine bleaches, and alkali. In addition, liquid automatic dishwashing detergents (LADDs) have been developed for use in dishwashing machines. LADDs overcome the caking problem associated with powdered products when stored in a humid environment.

To be effective, LADDs must be capable of pouring from its container while not leaking or draining once dispensed into the dispensing cup of a home dishwashing machine. This requires a fluid with thixotropic rheology. That is, the LADD must be much less fluid under static conditions than under the dynamic conditions of dispensing the product from the container or when the product is released from the dispensing cup of an automatic dishwasher. In practice, this means that an LADD must exhibit a higher viscosity at low shear and a lower viscosity at high shear.

SUMMARY

The invention involves LADDs that contain a detergent enzyme and have a pH value less than 7.0. Such LADDs can lack phosphate builders, chlorine bleaches, and alkali, each of which is undesirable from the perspective of human and environmental safety. For example, detergents containing phosphate builders, chlorine bleaches, and alkali are highly irritating to the skin and especially to the eyes. Thus, any detergent that can avoid these harmful ingredients while maintaining the ability to clean tableware would be desirable.

The invention is based on the discovery that LADDs containing a detergent enzyme and having a pH value less than 7.0 provide superior cleaning performance when compared to an alkaline LADD containing chlorine bleach and phosphate builders. In other words, non-alkaline LADDs lacking chlorine bleach and phosphate builders can be used to clean tableware effectively. Such LADDs can be used at relatively low dosages to achieve a cleaning performance comparable to that obtained using much higher dosages of, for example, alkaline LADDs containing chlorine bleach and phosphate builders.

The invention also is based on the discovery that LADDs containing a detergent enzyme and having a pH value less than 7.0 exhibit significant enzyme stability when compared to similar detergents having a higher pH value. Thus, LADDs containing a detergent enzyme and having a pH value less than 7.0 would have a longer half-life than comparable alkaline LADDs.

It is noted that the term "by weight" as used herein with respect to a particular percent of an ingredient refers to that ingredient as is.

In general, the invention features a liquid automatic dishwashing detergent having a pH value less than 7.0 and containing at least one detergent enzyme. The detergent can be free of chlorine sources and/or phosphate builders. The detergent enzyme can include a protease and/or amylase. The protease can remain greater than 90 percent active after incubating the detergent at 30° C. for one week. In addition, the protease can remain greater than 80 percent active after incubating the detergent at 30° C. for two weeks. The amylase can remain greater than 35 percent active after incubating the detergent at 30° C. for one week. In addition, the amylase can remain greater than 30 percent active after incubating the detergent at 30° C. for two weeks. Further, 100 grams of the detergent can clean glasses such that the glasses have a grade value less than about 2.50 for spots after performing a standard wash test with 200 grams of Lemon Cascade™ Gel (an alkaline LADD product containing phosphates and chlorine) being used as a control set to a reference grade value of 1.90. One hundred grams of the detergent can clean flatware such that the flatware has a grade value less than about 2.50 for spots after performing a standard wash test with 200 grams of Lemon Cascade™ Gel being used as a control set to a reference grade value of 2.10. One hundred grams of the detergent can clean white plates such that the white plates have a grade value less than about 2.50 for spots after performing a standard wash test with 200 grams of Lemon Cascade™ Gel being used as a control set to a reference grade value of 1.70. One hundred grams of the detergent can clean gold plates such that the gold plates have a grade value less than about 2.50 for spots after performing a standard wash test with 200 grams of Lemon Cascade™ Gel being used as a control set to a reference grade value of 1.80. One hundred grams of the detergent can clean glasses such that the glasses have a grade value less than about 2.50 for film after performing a standard wash test with 200 grams of Lemon Cascade™ Gel being used as a control set to a reference grade value of 1.90. One hundred grams of the detergent can clean flatware such that the flatware has a grade value less than about 2.50 for film after performing a standard wash test with 200 grams of Lemon Cascade™ Gel being used as a control set to a reference grade value of 1.90. One hundred grams of the detergent can clean white plates such that the white plates have a grade value less than about 2.50 for film after performing a standard wash test with 200 grams of Lemon Cascade™ Gel being used as a control set to a reference grade value of 1.60. One hundred grams of the detergent can clean gold plates such that the gold plates have a grade value less than about 2.50 for film after performing a standard wash test with 200 grams of Lemon Cascade™ Gel being used as a control set to a reference grade value of 1.80. The pH value can be from about 4.5 to about 6.5 (e.g., from about 5.0 to about 6.5; from about 4.5 to about 6.0; and from about 5.0 to about 6.0). The detergent can contain at least one pH adjusting agent such that the detergent has the pH value. The enzyme can be from about 0.01 percent to about 10.0 percent of the detergent by weight (e.g., from about 0.05 percent to about 5.0 percent). The enzyme can contain an enzyme such as Alcalase™ (a serine protease), Esperase™ (a serine protease), Maxacal™ (a serine protease), Maxapem™ (an engineered serine protease), Maxatase™ (a serine protease), Opticlean™ (a protease), Optimase™ (a protease), and Savinase™ (a serine protease). The detergent can be thixotropic. The detergent can contain at least one thixotropic thickener. The thickener can be from about 0.05 percent to about 10.0 percent of said detergent by weight (e.g., from about 0.2 percent to about 5.0 percent or from about 0.5 percent to about 5.0 percent). The thickener can be cross-linked polycarboxylate polymers and/or xanthan gums. The detergent can contain at least one low foaming nonionic surfactant. The surfactant can be from about 0.01 percent to about 20.0 percent of the detergent by weight (e.g., from about 0.05 percent to about 5.0 percent). The surfactant can be a surfactant selected from the following group: (a) first condensation products, where the first condensation products are condensates from a first mixture containing about one mole of a straight or branched chain fatty alcohol or acid and from about four to about forty moles of ethylene oxide, where the alcohol or acid is saturated or unsaturated, and where the chain of the alcohol or acid contains from about ten to about twenty carbon atoms; (b) second condensation products, where the second condensation products are condensates from a second mixture containing about one mole of alkyl phenol and from about four to about fifty moles of ethylene oxide, where the alkyl chain of the alkyl phenol contains from about eight to about eighteen carbon atoms; (c) polyoxypropylene, polyoxyethylene condensates having the formula $R_1O(CH_2CH_2O)_x(CH(CH_3)CH_2O)_yR_2$, where $R_1$ is H or an alkyl group having from one to four carbon atoms, where $R_2$ is H or an alkyl group having from one to four carbon atoms, where x is an integer greater than or equal to one, where y is an integer greater than or equal to one, where the total $C_2H_4O$ content is from about 20 percent to about 90 percent of the total weight of the polyoxypropylene, polyoxyethylene condensates, and where the molecular weight of the polyoxypropylene, polyoxyethylene condensates is from about 2000 Daltons to about 10,000 Daltons; and (d) capped condensates, where the capped condensates contain the polyoxypropylene, polyoxyethylene condensates capped with at least one capping molecule, the capping molecule being a propylene oxide, butylene oxide, short chain alcohols, and/or short chain fatty acids. The detergent can contain at least one calcium ion source. The calcium ion source can be from about 0.01 percent to about 5.0 percent of the detergent by weight. The detergent can contain at least one enzyme stabilizer. The enzyme stabilizer can be from about 0.01 percent to about 30.0 percent of the detergent by weight. The enzyme stabilizer can be selected from the following group: propylene glycol, sorbitol, fructose, sucrose, glucose, short chain carboxylic acids, salt forms of short chain carboxylic acids, polyhydroxyl compounds, boric acid, soluble salt forms of boric acid, boronic acid, and soluble salt forms of boronic acid. The detergent can contain at least one non-phosphate detergent builder. The non-phosphate detergent builder can be from about 0.5 percent to about 30.0 percent of the detergent by weight (e.g., from about 1.0 percent to about 20.0 percent). The non-phosphate detergent builder can be selected from the following group: citric acid, alkali metal forms of citric acid, and ammonium salt forms of citric acid. The detergent can contain at least one organic dispersant. The dispersant can be from about 0.5 percent to about 30.0 percent of the detergent by weight (e.g., from about 1.0 percent to about 20.0 percent). The dispersant can be a soluble salt of a polymer or copolymer of acrylic acid. The dispersant can be a mixture of soluble salts of one or more acrylic acid polymers or copolymers having a molecular weight less than about 5,000 Daltons and one or more acrylic acid polymers or copolymers having a molecular weight of greater than about 500,000 Daltons. The detergent can contain a mixture of at least one non-phosphate detergent builder and at least one organic dispersant. The mixture can be from about 0.5 percent to about 30.0 percent of said detergent by weight. The detergent can contain, by weight: (a) from about 0.05 percent to about 10.0 percent of a thixotropic thickener, (b) from about 0.00 percent to about 20.0 percent of a low foaming nonionic surfactant, (c) from about 0.01 percent to about 10.0 percent of the enzyme, the enzyme being a protease, (d) from about 0.01 percent to about 5.0 percent of a calcium ion source, (e) from about 0.00 percent to about 30.0 percent of an enzyme stabilizer, (1) from about 0.5 percent to about 30.0 percent of a non-phosphate detergent builder, an organic dispersant, or mixture thereof, (g) a sufficient amount of a pH adjusting agent such that the detergent has the pH value. The detergent can contain, by weight: (a) from about 0.5 percent to about 5.0 percent of a thixotropic thickener, (b) from about 0.05 percent to about 5.0 percent of a low foaming nonionic surfactant, (c) from about 0.05 percent to about 5.0 percent of the enzyme, the enzyme being a protease, (d) from about 0.01 percent to about 1.0 percent of a calcium ion source, (e) from about 0.5 percent to about 10.0 percent of an enzyme stabilizer, (f) from about 1.0 percent to about 20.0 percent of a non-phosphate detergent builder, (g) from about 1.0 percent to about 20.0 percent of a soluble salt of a polymer or copolymer of acrylic, and (h) a sufficient amount of a pH adjusting agent such that the detergent has a pH value from about 5.0 to about 6.5. The detergent can contain, by weight, about 55 percent water, about 7 percent citric acid; about 5 percent propylene glycol; about 2 percent Carbopol™ 676 (a carboxyvinyl polymer); about 8 percent NaOH, 50% aq.; about 1 percent sodium borate decahydrate or about 1 percent sodium borate pentahydrate; about 2 percent sodium citrate; about 2 percent sodium formate; about 0.1 percent calcium chloride; about 5 percent sodium xylene sulfonate, 40% aq.; about 2 percent Pluronic™ $25R_2$ (a polyalkylene oxide block copolymer); about 10 percent Burcosperse™ AP (a polyacrylate dispersant); about 1 percent Savinase™ 16.0 L; and about 0.1 percent Surcide P™ (hexahydro 1-, 3-, 5-tris 2-hydroxy ethyl-s-triazine).

In another aspect, the invention features a method of cleaning tableware in an automatic dishwashing machine. The method includes dispensing an effective amount of a liquid automatic dishwashing detergent into the dispensing cup of the machine. The detergent contains at least one detergent enzyme and has a pH value less than 7.0.

Unless otherwise defined, all technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

The invention provides methods and materials related to cleaning tableware. Specifically, the invention provides LADDs with a pH less than about 7.0. In other words, the LADDs of the invention have little, if any, alkali. In addition, the invention provides LADDs having a detergent enzyme as an active ingredient. Thus, the LADDs of the invention can lack phosphate builders and chlorine bleaches, while maintaining superior cleaning performance.

The term "detergent enzyme" as used herein refers to any enzyme preparation having the ability to aid in the cleaning process including, without limitation, the removal of debris (e.g., proteinaceous organic food soils and starch-containing food residues), the degradation of debris, and the removal and prevention of spots and film after the wash cycle. Detergent enzymes can be proteases or amylases. Examples of protease enzyme detergents include, without limitation, Savinase™, Alcalase™, Esperase™, Maxatase™, Maxacal™ and Maxapem™. Examples of amylase enzyme detergents include, without limitation, Maxamyl™ (a bacterial amylase), Termamyl™ (a bacterial amylase), and BAN™ (a bacterial amylase).

The LADDs of the invention can contain at least one detergent enzyme. In addition, an LADD can contain any combination of different detergent enzymes. For example, an LADD can contain two different protease detergent enzymes as well as one amylase detergent enzyme.

The LADDs of the invention can also contain a thixotropic thickener. The term "thixotropic thickener" as used herein refers to any compound that provides thixotropic properties to an LADD. Examples of thixotropic thickeners include, without limitation, cross-linked polycarboxylate polymers and xanthan gums. Cross-linked polycarboxylate polymers include, without limitation, carboxyvinyl polymers such as those disclosed in U.S. Pat. No. 2,798,053 and commercially available from B. F. Goodrich Company, New York, N.Y. under the trade name Carbopol™. Other suitable cross-linked polycarboxylate polymers include, without limitation, products marketed under the trade name Polygel™ and available from 3V.

Xanthan gums are biopolysaccharides obtained from the growth of *Xanthomonas* spp. Suitable xanthan gums include, without limitation, products sold by Kelco Corporation under the trade names Keltrol™ and Kelzan™ as well as products sold by Rhodia under the trade names Rhodipol™ and Rhodigel™. These and other xanthan gum products are well known in the art. It is noted, however, that xanthan gums have generally not been used in the formulation of LADD compositions since they were thought to be susceptible to depolymerization by amylase enzymes. As described herein, the thixotropic rheology of LADDs containing xanthan gum is retained during storage even though the composition may contain substantial amounts of an amylase enzyme.

The LADDs of the invention can contain at least one thixotropic thickener. In addition, an LADD can contain any combination of different thixotropic thickeners. For example, an LADD can contain two different cross-linked polycarboxylate polymers as well as xanthan gum.

The LADDs of the invention can also contain a surfactant. For example, an LADD within the scope of the invention can contain a nonionic surfactant (e.g., a low-foaming nonionic surfactant). A low-foaming nonionic surfactant is a surfactant that foams little, if at all, during the wash cycle of an automatic dishwashing appliance. In addition, a low-foaming nonionic surfactant can function to suppress foaming during the wash cycle caused by food residues. Examples of nonionic surfactants include, without limitation, various condensation products. For example, the condensation product from a mixture of about one mole of a fatty alcohol or fatty acid and about four to about forty moles of ethylene oxide can be used. The fatty alcohol or fatty acid can be saturated or unsaturated while the chain can be straight or branched. In addition, the chain can contain from ten to twenty carbon atoms. Another nonionic surfactant can be the condensation product from a mixture of about one mole of alkyl phenol and about four to about fifty moles of ethylene oxide. The alkyl chain of the alkyl phenol can contain from eight to eighteen carbon atoms. Further, polyoxypropylene, polyoxyethylene condensates can be used as nonionic surfactants. Polyoxypropylene, polyoxyethylene condensates can have a chemical formula of $R_1O(CH_2CH_2O)_x(CH(CH_3)CH_2O)_yR_2$ where $R_1$ can be H or an alkyl group having from one to four carbon atoms, where $R_2$ can be H or an alkyl group having from one to four carbon atoms, where x is an integer greater than or equal to one, where y is an integer greater than or equal to one, and where the total $C_2H_4O$ content equals about 20 percent to about 90 percent (e.g., about 20, 25, 30, 35, 40, 45, 50, 55, 60, 65, 70, 75, 80, 85, or 90 percent) of the total weight of the condensation product. In addition, the molecular weight of the polyoxypropylene, polyoxyethylene condensates can be from about 2,000 Daltons to about 10,000 Daltons. Moreover, polyoxypropylene, polyoxyethylene condensates can be capped or uncapped. For example, polyoxypropylene, polyoxyethylene condensates can be capped with propylene oxide, butylene oxide, short chain alcohols, short chain fatty acids, or combinations thereof. Other nonionic surfactants include, without limitation, those described in McCutcheon's Emulsifiers and Detergents, 1999 North American Edition.

In addition, the LADDs of the invention can contain a surfactant that is an anionic surfactant. When anionic surfactants are used, care should be taken to prevent excessive foaming. For example, an anionic surfactant that is a weak foamer can be selected or foam suppressing additives (e.g., fatty acids having twelve to twenty carbon atoms, divalent metal salts of fatty acids having twelve to twenty carbon atoms, phosphate esters of fatty alcohols having twelve to twenty carbon atoms, and phosphate esters of a condensate of one mole of fatty alcohol of twelve to twenty carbon atoms with one to twenty moles of ethylene oxide) can be used in conjunction with an anionic surfactant. Examples of anionic surfactants include, without limitation, disodium alkylether sulfosuccinates, alkali metal salts of a secondary alkane sulfonate, and water soluble sulfates and sulfonates of alcohols containing from eight to eighteen carbon atoms. Other anionic surfactants can be the sulfates of condensation products from a mixture of about one mole of a fatty alcohol and about one to about twenty moles of ethylene oxide. The chain of the fatty alcohol can contain eight to eighteen carbon atoms.

Further, the LADDs of the invention can contain a surfactant that is an amphoteric surfactant. Amphoteric surfactants include, without limitation, betaine surfactants, fatty amphoacetates, and fatty amphodiacetates. For example, an LADDs of the invention can contain a capric/caprylic amidoalkyl betaine available from Goldschmidt Chemical Corp under the trade name Tegobetaine™ 810 Moreover, the LADDs of the invention can contain a surfactant that is a zwitterionic surfactant. Zwitterionic surfactants include, without limitation, sulfobetaines.

The LADDs of the invention can contain at least one surfactant. In addition, an LADD can contain any combination of different surfactants. For example, an LADD can contain two different nonionic surfactants, one anionic surfactant, and one zwitterionic surfactant.

The LADDs of the invention can also contain an enzyme stabilizer. The term "enzyme stabilizer" as used herein refers to any compound that enhances or maintains the stability of a detergent enzyme within an LADD. Examples of enzyme stabilizers include, without limitation, calcium ions, propylene glycol, sorbitol, boric acid, soluble salts of boric acid, boronic acids, soluble salts of boronic acids, polyhydroxy compounds, carboxylic acids having from one to six carbon atoms, and salt forms of carboxylic acids having from one to six carbon atoms. Any source can be used to provide calcium ions. For example, soluble salts of calcium such as calcium chloride, bromide, iodide, and nitrate can be used. Typically, the source of calcium ions has a moderate degree of solubility such that the calcium ions become available. Calcium ions can also be provided by slightly soluble salts (e.g., calcium sulfate). In addition, calcium ions can be introduced as the salt of another enzyme stabilizer (e.g., formic acid or acetic acid) or as the salt of a non-phosphate builder (e.g., citric acid). Care should be taken to avoid using excessive amounts of calcium ion in an LADD since this may result in the precipitation of calcium salts. When calcium ions are used as an enzyme stabilizer, the amount, by weight, of calcium is typically in the range of about 0.01 percent to about 1.0 percent or in the range of about 0.05 percent to about 0.5 percent expressed as calcium chloride.

When boric acid (or a salt form of boric acid) is used as an enzyme stabilizer, the amount, by weight, is typically in the range from about 0.1 percent to about 4.0 percent or in the range from about 0.2 percent to about 2.0 percent expressed as sodium tetraborate decahydrate. When propylene glycol is used as an enzyme stabilizer, the amount, by weight, is typically in the range from about 1.0 percent to about 20.0 percent or in the range from about 2.0 percent to about 20.0 percent. In addition, propylene glycol is typically used in combination with boric acid or a soluble salt of boric acid. When sorbitol is used as an enzyme stabilizer, the amount, by weight, is typically in the range from about 1.0 percent to about 20.0 percent or in the range from about 2.0 percent to about 20.0 percent. In addition, sorbitol is typically used in combination with boric acid or a soluble salt of boric acid. When sucrose is used as an enzyme stabilizer, the amount, by weight, is in the range from about 10.0 percent to about 30.0 percent or in the range from about 15.0 percent to about 25.0 percent.

The LADDs of the invention can contain at least one enzyme stabilizer. In addition, an LADD can contain any combination of different enzyme stabilizers. For example, an LADD can contain calcium ions, sorbitol, and boric acid.

The LADDs of the invention also can contain a non-phosphate builder, an organic dispersant, or mixtures thereof. Examples of non-phosphate builders include, without limitation, citric acid, soluble salt forms of citric acid, nitrilotriacetic acid, soluble salt forms of nitrilotriacetic acid, sodium carboxymethyl oxymalonate, sodium carboxymethyl oxysuccinate, polymers of acrylic acid, copolymers of acrylic acid, polymers of maleic acid, and copolymers of maleic acid. Examples of organic dispersants include, without limitation, maleic anhydride copolymers, polyaspartic acid polymers, soluble salt forms of low molecular weight acrylic acid polymers, and partially hydrolyzed polyacrylamides. Typically, an LADD contains from about 0.5 percent to about 30.0 percent, by weight, of a non-phosphate detergency builder, an organic dispersant, or mixtures thereof. Thus, an LADD can contain citric acid, maleic acid polymers, and soluble salt forms of low molecular weight acrylic acid polymers.

The LADDs of the invention also can contain a variety of other ingredients including, without limitation, hydrotropes, preservatives, fragrances, colorants, foam inhibitors, corrosion inhibitors, pH adjusting agents, and the like. For example, an LADD within the scope to the invention can contain any of the material described in U.S. Pat. No. 5,691,292.

As described herein, the invention provides LADDs having a pH value less than about 7.0 (e.g., less than about 6.8, 6.6, 6.4, 6.2, 6.0, 5.8, 5.6, 5.4, 5.2, 5.0, 4.8, 4.6, 4.4, 4.2, and 4.0). For the purpose of this invention and unless otherwise indicated, a pH value refers to the pH value of an undiluted product. The pH value of a particular LADD can be adjusted to a value less than about 7.0 (e.g., a value between 4.0 and 7.0). It will be appreciated that the pH value of an LADD can be adjusted either by using any of a wide variety of acids should the LADD have a pH value greater than about 7.0 before adjustment, or by using any of a wide variety of bases should the LADD have a pH value lower than desirable (e.g., below about 4.0) before adjustment. As described herein, LADDs having a pH value greater than 7.0 can have reduced detergent enzyme stability resulting in poorer cleaning performance.

The LADDs of the invention can be prepared using any method. For example, after dispersing a thixotropic thickener in water, enzyme stabilizers, surfactants, detergency builders (e.g., non-phosphate builders), organic dispersants, and optional ingredients such as hydrotropes, preservatives, and colorants can be added. After adding these ingredients, the pH can be adjusted to the desired pH value with a pH adjusting agent. Once the pH is adjusted, detergent enzymes and fragrances can be added. Alternatively, after dispersing a thixotropic thickener in water, part of the pH adjusting agent can be added followed by enzyme stabilizers, surfactants, detergency builders (e.g., non-phosphate builders), organic dispersants, and optional ingredients such as hydrotropes, preservatives, fragrances and colorants. After adding these ingredients, the pH can be adjusted to the desired pH value with additional pH adjusting agent and the detergent enzymes can be added. In some cases, it can be desirable to prepare a concentrated dispersion of thixotropic thickener in water. The desired amount of this concentrated thixotropic thickener dispersion can then be added to a separate solution containing the following ingredients dissolved in water: enzyme stabilizers, surfactants, detergency builders (e.g., non-phosphate builders), organic dispersants, and optional ingredients such as hydrotropes, preservatives, fragrances, and colorants. After adding the concentrated thixotropic thickener dispersion, the pH value can be adjusted to the desired pH value by adding a pH adjusting agent. After adjusting the pH value, detergent enzymes can be added.

When the thixotropic thickener is a cross-linked polycarboxylate polymer such as Carbopol™ 676, it may be desirable to dissolve a weak acid in water prior to dispersing the thixotropic thickener in order to retard hydration of the thixotropic thickener. In this case, the process can involve dissolving citric acid in water, dispersing the thixotropic thickener, and adding part of the pH adjusting agent followed by the addition of enzyme stabilizers, surfactants, detergency builders (e.g., non-phosphate builders), organic dispersants, and optional ingredients such as hydrotropes, preservatives, fragrances, and colorants. Then, the pH value can be adjusted to the desired pH value using a pH adjusting agent, and the detergent enzymes added.

When the ratio of thixotropic thickener to water in the LADD is high, it may be desirable to preblend the thixotropic thickener with a non-aqueous ingredient prior to addition. For example, the thixotropic thickener can be dry blended with a solid ingredient or dispersed in a non-aqueous liquid ingredient prior to addition.

It will be appreciated that many other process variations can be employed to prepare a LADD within the scope of the invention without departing from the principles taught herein. Process variations, however, should minimize exposing detergent enzymes to pH and temperature conditions that might wholly or partially inactivate the detergent enzymes. Thus, the final pH value of an LADD should be adjusted to a value between about 4.0 and 7.0.

The invention will be further described in the following examples, which do not limit the scope of the invention described in the claims.

EXAMPLES

Example 1

Preparation of Formula M101

Formula M101 was prepared to contain the indicated ingredients in Table 1. Specifically, the propylene glycol and citric acid were dissolved in the deionized water. Once dissolved, the Carbopol™ was added, and the solution agitated at room temperature until dispersed. Typically, this took about 40 minutes. The agitation was continued while the sodium hydroxide solution was gradually added. The borax, sodium citrate, sodium formate, calcium chloride, Pluronic™, and Burcosperse™ AP were added at room temperature. Then, the Savinase™, Termamyl™, fragrance, and Surcide™ were added, and the mixture agitated at room temperature for an additional 20 minutes.

TABLE 1

Ingredients expressed as percent by weight for the indicated LADD formulas.

| Formula | M101 | M102 | M103 | M104 | M105 | M106 |
|---|---|---|---|---|---|---|
| Example Number | 1 | 2 | 3 | 4 | 5 | 5 |
| Purified water | 61.47 | 60.3 | 53.38 | 55.13 | 54.065 | 50.95 |
| Citric acid | 2.43 | 1.0 | 6.6 | 6.02 | 7.0 | 7.5 |
| Propylene glycol | 5.0 | 5.0 | 5.0 | 5.00 | 5.0 | 5.0 |
| Sorbitol, 70% aq. | 0 | 0 | 0 | 0 | 0 | 0 |
| Sucrose | 0 | 0 | 0 | 0 | 0 | 0 |
| Xanthan[1] | 0.0 | 1.1 | 0.0 | 0 | 0 | 0 |
| Carbopol ™ 676[2] | 2.3 | 0.0 | 2.2 | 2.2 | 2.2 | 2.2 |
| NaOH, 50% aq. | 4.6 | 0.0 | 8.97 | 5.8 | 7.885 | 10.5 |
| Sodium borate pentahydrate | 1.0 | 2.0 | 1.0 | 1.0 | 1.0 | 1.0 |
| Sodium citrate | 6.5 | 8.75 | 2.0 | 4.0 | 2.0 | 2.0 |
| Sodium formate | 2.0 | 2.0 | 2.0 | 2.0 | 2.0 | 2.0 |
| Calcium chloride | 0.10 | 0.1 | 0.10 | 0.10 | 0.10 | 0.10 |
| Mono-ethanolamine | 0 | 0.25 | 0.0 | 0.0 | 0 | 0 |
| Sodium xylene sulfonate, 40% | 0 | 5.0 | 5.0 | 5.0 | 5.0 | 5.0 |
| Pluronic ™ 25R2[3] | 2.0 | 3.0 | 2.0 | 2.0 | 2.0 | 2.0 |
| Burcosperse ™ AP[4] | 10.0 | 10.0 | 10.0 | 10.0 | 10.0 | 10.0 |
| Savinase ™ 16.0L[5] | 1.0 | 0.70 | 0.75 | 0.75 | 0.75 | 0.75 |
| Termamyl ™[5] | 1.5 | 0.50 | 0.70 | 0.70 | 0.70 | 0.70 |
| Fragrance | 0.0 | 0.2 | 0.2 | 0.2 | 0.2 | 0.2 |
| Surcide P ™[6] | 0.10 | 0.10 | 0.10 | 0.1 | 0.10 | 0.10 |
| pH (20% in water) | 6.55 | 6.6 | 6.12 | 5.8 | 6.0 | 7.67 |
| Viscosity[7] | | | 61,710 | 74,060 | 58,430 | 41,820 |

TABLE 1-continued

Ingredients expressed as percent by weight for the indicated LADD formulas.

| Formula | M107 | M108 | M109 | M110 | M111 |
|---|---|---|---|---|---|
| Example | 7 | 8 | 9 | 10 | 10 |
| Purified water | 54.765 | 56.85 | 34.63 | 53.25 | 48.75 |
| Citric Acid | 7.0 | 7.5 | 6.52 | 7.5 | 7.5 |
| Propylene glycol | 5.0 | 5.0 | 5.0 | 0 | 0 |
| Sorbitol, 70% aq. | 0 | 0 | 0 | 5.0 | 10.0 |
| Sucrose | 0 | 0 | 20.0 | 0 | 0 |
| Xanthan[1] | 0.0 | 1.2 | 0.0 | 0 | 0 |
| Carbopol ™ 676[2] | 2.2 | 0.0 | 2.2 | 2.2 | 2.0 |
| NaOH, 50% aq. | 7.885 | 6.1 | 5.8 | 8.7 | 8.4 |
| Sodium borate pentahydrate | 1.0 | 1.0 | 1.0 | 1.0 | 1.0 |
| Sodium citrate | 2.0 | 2.0 | 4.0 | 2.0 | 2.0 |
| Sodium formate | 2.0 | 2.0 | 2.0 | 2.0 | 2.0 |
| Calcium chloride | 0.1 | 0.3 | 0.1 | 0.3 | 0.3 |
| Mono-ethanolamine | 0 | 0 | 0.0 | 0 | 0 |
| Sodium xylene sulfonate, 40% | 5.0 | 5.0 | 5.0 | 5.0 | 5.0 |
| Pluronic ™ 25R2[3] | 2.0 | 2.0 | 2.0 | 2.0 | 2.0 |
| Burcosperse ™ AP[4] | 10.0 | 10.0 | 10.0 | 10.0 | 10.0 |
| Savinase ™ 16.0L[5] | 0.75 | 0.75 | 0.75 | 0.75 | 0.75 |
| Termamyl ™[5] | 0 | 0 | 0.70 | 0 | 0 |
| Fragrance | 0.2 | 0.2 | 0.2 | 0.2 | 0.2 |
| Surcide P ™[6] | 0.10 | 0.10 | 0.10 | 0.10 | 0.10 |
| pH (20% in water) | 6.04 | 5.70 | 5.49 | 6.02 | 5.94 |
| Viscosity[7] | 72,500 | 65,939 | 68,000 | 100,900 | 109,600 |

[1]provided by Keltrol SF, Kelco, Inc.;
[2]provided by B. F. Goodrich;
[3]provided by BASF, Inc.;
[4]provided by Burlington Corp.;
[5]provided by Novo Nordisk, Inc.;
[6]provided by Surfactants Inc.; and
[7]tested using Brookfield T-Bar Spindle C at 0.3 rpm.

Example 2

Preparation of Formula M102

Formula M102 was prepared to contain the indicated ingredients in Table 1. Specifically, the xanthan gum was dispersed in the water at room temperature, and mixture agitated until dispersed (about 30 minutes). Then, the propylene glycol and citric acid were added. The agitation was continued while the borax, monoethanolamine, sodium citrate, sodium formate, calcium chloride, sodium xylene sulfonate, Pluronic™, and Burcosperse™ AP were added at room temperature. After adding these ingredients, the Savinase™, Termamyl™, fragrance, and Surcide™ were added, and the mixture agitated at room temperature for an additional 20 minutes.

Example 3

Preparation of Formula M103

Formula M103 was prepared to contain the indicated ingredients in Table 1. Specifically, the propylene glycol and citric acid were dissolved in the deionized water. Then, the Carbopol™ was added to the solution, and the mixture agitated at room temperature until the Carbopol™ was dispersed (about 40 minutes). The agitation was continued while the sodium hydroxide solution was gradually added. The borax, sodium citrate, sodium formate, calcium chloride, sodium xylene sulfonate, Pluronic™, and Burcosperse™ AP were added at room temperature. After adding these ingredients, the Savinase™, Termamyl™, fragrance, and Surcide™ were added, and the mixture agitated at room temperature for an additional 20 minutes.

Example 4

Preparation of Formula M104

Formula M104 was prepared to contain the indicated ingredients in Table 1. Specifically, the propylene glycol and citric acid were dissolved in the deionized water. Then, the Carbopol™ was added to the solution, and the mixture agitated at room temperature until the Carbopol™ was dispersed (about 40 minutes). The agitation was continued while the sodium hydroxide solution was gradually added. The borax, sodium citrate, sodium formate, calcium chloride, sodium xylene sulfonate, Pluronic™, and Burcosperse™ AP were added at room temperature. After adding these ingredients, the Savinase™, Termamyl™, fragrance, and Surcide™ were added, and the mixture agitated at room temperature for an additional 20 minutes.

Example 5

Preparation of Formulas M105 and M 106

Formulas M105 and M106 were prepared to contain the indicated ingredients in Table 1. Specifically, an intermediate was prepared by dissolving the calcium chloride and 0.50 percent of the citric acid in 1.0 percent of the water. The propylene glycol and remaining citric acid were dissolved in the remaining water at room temperature. Then, the Carbopol™ was added to the solution, and the mixture agitated at room temperature until the Carbopol™ was dispersed (about 40 minutes). The agitation was continued while the sodium hydroxide solution was gradually added. The borax, sodium citrate, sodium formate, calcium chloride, sodium xylene sulfonate, Pluronic™, and Burcosperse™ AP were added at room temperature. The pH was then checked. The fragrance and Surcide™ were then added, and the mixture agitated at room temperature for an additional 20 minutes.

Immediately prior to beginning an enzyme stability evaluation on formulas M105 and M1106, the Savinase™ and Termamyl™ were added.

Example 6

Enzyme Stability Test Using Formulas M105 and M106

A test for the stability of detergent enzymes in formulas M105 and M106 was conducted as follows. Formulas M105 and M106 were prepared without addition of the detergent enzymes. Then, the pH value for each was determined. Formula M105 lacking the detergent enzymes exhibited a pH value of about 6.00, while formula M106 lacking the detergent enzymes exhibited a pH value of about 7.67. Then, the Savinase™ and Termamyl™ were added, and the samples incubated at 30° C. Table 2 contains the enzyme activities that were observed at the indicated time points.

TABLE 2

| | Enzyme stability. | | |
|---|---|---|---|
| Sample/Assay | Initial | 1 week | 2 weeks |
| Formula M105: | | | |
| Savinase ™ | 100% | 100% | 91% |
| Termamyl ™ | 100% | 83% | 67% |
| Formula M106: | | | |
| Savinase ™ | 100% | 88% | 79% |
| Termamyl ™ | 100% | 34% | 29% |

Both the protease detergent enzyme (i.e., Savinase™) and the amylase detergent enzyme (i.e., Termamyl™) were found to be much more stable in the formula having a pH value less than 7.0 (formula M105) than in the similar formula (formula M106) which differed only in that it had a slightly alkaline pH (pH=about 7.67).

Example 7

Preparation of Formula M107

Formula M107 was prepared to contain the indicated ingredients in Table 1 as well as a nominal amount of Melaleuca oil. Specifically, an intermediate was prepared by dissolving the calcium chloride and 0.50 percent of the citric acid in 1.0 percent of the water. The propylene glycol and the remaining citric acid were dissolved in the remaining water at room temperature. Then, the Carbopol™ was added to the solution, and the mixture agitated at room temperature until the Carbopol™ was dispersed (about 40 minutes). The agitation was continued while the sodium hydroxide solution was gradually added. The borax, sodium citrate, sodium formate, calcium chloride, sodium xylene sulfonate, Pluronic™ and Burcosperse™ AP were added at room temperature. Then, the Savinase™, fragrance, Surcide™, and Melaleuca oil were added, and the mixture agitated at room temperature for an additional 20 minutes.

One batch of formula M107 was made, and its pH tested at various dilutions in water. The results were as follows: undiluted M107 had a pH value of 5.64; 50 percent M107 in water had a pH value of 5.70; and 20 percent M107 in water had a pH value of 5.84.

Example 8

Preparation of Formula Ml 08

Formula M108 was prepared to contain the indicated ingredients in Table 1. Specifically, the xanthan gum was dispersed in the water at room temperature by agitation (about 30 minutes). Then, the propylene glycol and citric acid were added. The agitation was continued while the sodium hydroxide solution, borax, sodium citrate, sodium formate, calcium chloride, sodium xylene sulfonate, Pluronic™, and Burcosperse™ AP were added at room temperature. After adding these ingredients, the Savinase™, fragrance, and Surcide™ were added, and the mixture agitated at room temperature for an additional 20 minutes.

Example 9

Preparation of Formula M109

Formula M109 was prepared to contain the indicated ingredients in Table 1. Specifically, an intermediate was prepared by dissolving the calcium chloride and 0.50 percent of the citric acid in 1.0 percent of the water. The propylene glycol and remaining citric acid were dissolved in the remaining water at room temperature. The Carbopol™ and sucrose were dry blended, and the blended mixture added to the aqueous solution with agitation. Agitation continued for 30 minutes to disperse the polymer. Then, the sodium hydroxide solution was added followed by the borax, sodium formate, and sodium citrate with agitation to obtain a uniform composition after each addition. After obtaining a uniform composition, the calcium chloride solution was added followed by the addition of the sodium xylene sulfonate, Pluronic™, 25R2, and Burcosperse™ AP with agitation. Then, the pH was checked and found to be less than 7.0. At this point, the detergent enzymes, fragrance, and preservative were added at a temperature of 30° C. or less. After adding all the ingredients, the viscosity and pH were measured.

Example 10

Preparation of Formulas M110 and M111

Formulas M110 and M111 were prepared to contain the indicated ingredients in Table 1 as well as a nominal amount of Melaleuca oil. Specifically, an intermediate was prepared by dissolving the calcium chloride and 2.0 percent of the citric acid in 1.7 percent of the water. The sorbitol and remaining citric acid were dissolved in the remaining water at room temperature. Then, the Carbopol™ was added to the solution containing the sorbitol and citric acid, and the mixture agitated at room temperature until the Carbopol™ was dispersed (about 40 minutes). The agitation was continued while the sodium hydroxide solution was gradually added to the solution containing the Carbopol™, sorbitol, and citric acid. Then, the borax, sodium citrate, sodium formate, sodium xylene sulfonate, Pluronic™, and Burcosperse™ AP as well as the intermediate solution containing the calcium chloride and citric acid were added at room temperature. After adding these ingredients, the Savinase™, fragrance, Surcide™, and Melaleuca oil were added, and the mixture agitated at room temperature for an additional 20 minutes.

665) and a standard test described by the American Society for Testing and Materials (ASTM 3556-85, Standard Test Method for Deposition on Glassware During Mechanical Dishwashing). The wash load consisted of six glass tumblers in the upper basket as well as six complete sets of flatware, three 10-inch white Corelle™ plates, and three 10-inch gold stoneware plates in the lower basket. Prior to washing, all six plates were soiled using the 5.3 soil specified in ASTM 3556-85. The hardness of incoming water was boosted by addition of 1.5 g $CaCl_2$ and 0.75 g $MgCl_2*6H_2O$ to each 2.3 gallons of incoming water. This corresponds to an addition of 200 parts per million (ppm) of hardness calculated as $CaCO_3$. The glasses, flatware, white plates, and gold plates were graded for spots and film after two wash cycles using the grading scale provided in Table 3.

TABLE 3

Grading scale.

| Grade | Spots | Film |
|---|---|---|
| 1 | None | None |
| 2 | Random Spots | Barely Perceptible Film |
| 3 | ¼ Area Covered | Slight Film |
| 4 | ½ Area Covered | Moderate Film |
| 5 | Completely Covered | Heavy Film |

For comparison, a competitive retail LADD product (Lemon Cascade™ Gel) was evaluated along with formula M104. Lemon Cascade™ Gel contains chlorine bleach and phosphates, and is highly alkaline. Five replicate evaluations were performed for each LADD. In addition, each LADD was evaluated at two dosage levels. Table 4 contains the performance results.

TABLE 4

Performance results for the indicated LADDs.

| Test Article Product/Dosage | Spots Glass | Spots Flatware | Spots White Plate | Spots Gold Plate | Film Glass | Film Flatware | Film White Plate | Film Gold Plate |
|---|---|---|---|---|---|---|---|---|
| M104/200 g | 1.50 | 1.60 | 1.60 | 1.40 | 1.80 | 2.10 | 1.30 | 1.30 |
| M104/100 g | 1.50 | 1.20[2] | 1.60[1] | 1.20[1,2] | 1.10[1,2] | 2.20[1] | 1.90[1] | 1.20[1] |
| Lemon Cascade ™ Gel/200 g | 1.90 | 2.10 | 1.70 | 1.80 | 1.90 | 1.90 | 1.60 | 1.80 |
| Lemon Cascade ™ Gel/100 g | 1.60 | 1.40 | 2.30 | 2.10 | 3.80 | 4.20 | 3.20 | 3.30 |

[1]indicates that the value is significantly superior to the value obtained using Lemon Cascade ™ Gel dosed at 100 g (95% confidence);
[2]indicates that the value is significantly superior to the value obtained using Lemon Cascade ™ Gel dosed at 200 g (95% confidence).

Example 11

Performance Test Using Formula M104 and Lemon Cascade™ Gel

Formula M104 was evaluated for cleaning performance using a Sears Kenmore Ultrawash machine (Model Number Formula M104 dosed at a total of 100 g per wash load provided superior cleaning when compared to the Lemon Cascade™ Gel dosed at 100 g per wash load, and at least equivalent cleaning when compared to the Lemon Cascade™ Gel dosed at 200 g per wash load. This demonstrates the effectiveness LADDs of the invention when compared to state of the art alkaline LADD products containing phosphates and chlorine.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A liquid automatic dishwashing detergent having a pH value less than 6.8, wherein said detergent comprises, by weight:

(a) from about 0.05 percent to about 5.0 percent of at least one detergent enzyme, (b) from about 0.2 percent to about 5.0 percent of at least one xanthan gum, (c) from about 0.05 percent to about 5.0 percent of at least one low foaming nonionic surfactant, (d) from about 0.5 percent to about 30.0 percent of at least one non-phosphate detergent builder, and (e) from about 0.01 percent to about 30.0 percent of at least one enzyme stabilizer.

2. The detergent of claim 1, wherein said detergent is free of chlorine sources.

3. The detergent of claim 1, wherein said detergent is free of phosphate builders.

4. The detergent of claim 1, wherein said enzyme comprises a protease that remains greater than 90 percent active in said detergent after incubating said detergent at 30° C. for one week.

5. The detergent of claim 1, wherein said enzyme comprises a protease that remains greater than 80 percent active in said detergent after incubating said detergent at 30° C. for two weeks.

6. The detergent of claim 1, wherein said enzyme comprises an amylase that remains greater than 35 percent active in said detergent after incubating said detergent at 30° C. for one week.

7. The detergent of claim 1, wherein said enzyme comprises an amylase that remains greater than 30 percent active in said detergent after incubating said detergent at 30° C. for two weeks.

8. The detergent of claim 1, wherein said surfactant comprises a surfactant selected from the group consisting of:

(a) first condensation products, wherein said first condensation products are condensates from a first mixture containing about one mole of a straight or branched chain fatty alcohol or acid and from about four to about forty moles of ethylene oxide, wherein said alcohol or acid is saturated or unsaturated, and wherein the chain of said alcohol or acid contains from about ten to about twenty carbon atoms;

(b) second condensation products, wherein said second condensation products are condensates from a second mixture containing about one mole of alkyl phenol and from about four to about fifty moles of ethylene oxide, wherein the alkyl chain of said alkyl phenol contains from about eight to about eighteen carbon atoms;

(c) polyoxypropylene, polyoxyethylene condensates having the formula $R_1O(CH_2CH_2O)_x(CH(CH_3)CH_2O)_yR_2$, wherein $R_1$ is H or an alkyl group having from one to four carbon atoms, wherein $R_2$ is H or an alkyl group having from one to four carbon atoms, wherein x is an integer greater than or equal to one, wherein y is an integer greater than or equal to one, wherein the total $C_2H_4O$ content is from about 20 percent to about 90 percent of the total weight of said polyoxypropylene, polyoxyethylene condensates, and wherein the molecular weight of said polyoxypropylene, polyoxyethylene condensates is from about 2000 Daltons to about 10,000 Daltons; and (d) capped condensates, wherein said capped condensates comprise said polyoxypropylene, polyoxyethylene condensates capped with at least one capping molecule, said capping molecule being selected from the group consisting of propylene oxide, butylene oxide, short chain alcohols, and short chain fatty acids.

9. The detergent of claim 1, wherein said non-phosphate detergent builder is selected from the group consisting of citric acid, alkali metal salt forms of citric acid, and ammonium salt forms of citric acid.

10. The detergent of claim 1, wherein said enzyme stabilizer is selected from the group consisting of propylene glycol, sorbitol, fructose, sucrose, glucose, short chain carboxylic acids, salt forms of short chain carboxylic acids, polyhydroxyl compounds, boric acid, soluble salt forms of boric acid, boronic acid, and soluble salt forms of boronic acid.

11. The detergent of claim 1, wherein 100 grams of said detergent cleans glasses such that said glasses have a grade value less than about 2.50 for spots after performing a standard wash test with 200 grams of an alkaline liquid automatic dishwashing detergent being used as a control set to a reference grade value of 1.90, wherein said alkaline liquid automatic dishwashing detergent contains phosphates and chlorine.

12. The detergent of claim 1, wherein 100 grams of said detergent cleans flatware such that said flatware has a grade value less than about 2.50 for spots after performing a standard wash test with 200 grams of an alkaline liquid automatic dishwashing detergent being used as a control set to a reference grade value of 2.10, wherein said alkaline liquid automatic dishwashing detergent contains phosphates and chlorine.

13. The detergent of claim 1, wherein 100 grams of said detergent cleans white plates such that said white plates have a grade value less than about 2.50 for spots after performing a standard wash test with 200 grams of an alkaline liquid automatic dishwashing detergent being used as a control set to a reference grade value of 1.70, wherein said alkaline liquid automatic dishwashing detergent contains phosphates and chlorine.

14. The detergent of claim 1, wherein 100 grams of said detergent cleans gold plates such that said gold plates have a grade value less than about 2.50 for spots after performing a standard wash test with 200 grams of an alkaline liquid automatic dishwashing detergent being used as a control set to a reference grade value of 1.80, wherein said alkaline liquid automatic dishwashing detergent contains phosphates and chlorine.

15. The detergent of claim 1, wherein 100 grams of said detergent cleans glasses such that said glasses have a grade value less than about 2.50 for film after performing a standard wash test with 200 grams of an alkaline liquid automatic dishwashing detergent being used as a control set to a reference grade value of 1.90, wherein said alkaline liquid automatic dishwashing detergent contains phosphates and chlorine.

16. The detergent of claim 1, wherein 100 grams of said detergent cleans flatware such that said flatware has a grade value less than about 2.50 for film after performing a standard wash test with 200 grams of an alkaline liquid automatic dishwashing detergent being used as a control set to a reference grade value of 1.90, wherein said alkaline liquid automatic dishwashing detergent contains phosphates and chlorine.

17. The detergent of claim 1, wherein 100 grams of said detergent cleans white plates such that said white plates have a grade value less than about 2.50 for film after performing a standard wash test with 200 grams of an alkaline liquid automatic dishwashing detergent being used as a control set to a reference grade value of 1.60, wherein said alkaline liquid automatic dishwashing detergent contains phosphates and chlorine.

18. The detergent of claim 1, wherein 100 grams of said detergent cleans gold plates such that said gold plates have a grade value less than about 2.50 for film after performing a standard wash test with 200 grams of an alkaline liquid automatic dishwashing detergent being used as a control set to a reference grade value of 1.80, wherein said alkaline liquid automatic dishwashing detergent contains phosphates and chlorine.

19. The detergent of claim 1, wherein said pH value is from about 5.0 to about 6.5.

20. The detergent of claim 1, wherein said pH value is from about 5.0 to about 6.0.

21. The detergent of claim 1, wherein said detergent comprises at least one pH adjusting agent such that said detergent has said pH value.

22. The detergent of claim 1, wherein said detergent comprises at least one calcium ion source.

23. The detergent of claim 22, wherein said calcium ion source comprises from about 0.01 percent to about 5.0 percent of said detergent by weight.

* * * * *